US008163105B2

(12) United States Patent
Yoneda et al.

(10) Patent No.: US 8,163,105 B2
(45) Date of Patent: Apr. 24, 2012

(54) CORROSION INHIBITION METHOD

(75) Inventors: Yutaka Yoneda, Tokyo (JP); Hajime Iseri, Tokyo (JP); Shintaro Mori, Tokyo (JP)

(73) Assignee: Kurita Water Industries Ltd., Tokyo (JP)

( * ) Notice: Subject to any disclaimer, the term of this patent is extended or adjusted under 35 U.S.C. 154(b) by 1124 days.

(21) Appl. No.: 11/085,578

(22) Filed: Mar. 22, 2005

(65) Prior Publication Data

US 2005/0221013 A1 Oct. 6, 2005

(30) Foreign Application Priority Data

Mar. 31, 2004 (JP) ..... 2004-103429

(51) Int. Cl.
*C23C 28/02* (2006.01)
*C23C 22/08* (2006.01)

(52) U.S. Cl. ..... 148/253; 106/14.12; 148/255; 148/256; 148/259; 148/262; 148/263

(58) Field of Classification Search ..... 106/14.12; 148/253, 255–256, 259, 262–263
See application file for complete search history.

(56) References Cited

U.S. PATENT DOCUMENTS 2,337,856 A 12/1943 Rice et al.
2,954,309 A * 9/1960 Swalm et al. ..... 148/255
3,081,146 A * 3/1963 Boies et al. ..... 422/18
4,588,519 A 5/1986 Kuhn
5,531,934 A * 7/1996 Freeman et al. ..... 252/390
6,585,933 B1 * 7/2003 Ehrhardt et al. ..... 422/16

FOREIGN PATENT DOCUMENTS

| | | |
|---|---|---|
| GB | 1060158 | 3/1967 |
| JP | 2000-5742 | 1/2000 |
| JP | 2003-105573 | 4/2003 |

* cited by examiner

*Primary Examiner* — Lois Zheng
(74) *Attorney, Agent, or Firm* — Manabu Kanesaka

(57) ABSTRACT

The present invention provides a corrosion inhibition method which minimizes environmental adverse effects by using phosphate base anticorrosives without using zinc salt base anticorrosives and by reducing the concentration of the phosphate base anticorrosives, enables stable formation of an effective initial protective film, and does not affect water treatment after the formation of the initial protective film. In an initial protective film formation process of forming an initial protective film on a surface of an iron-based metallic member of a water system by adding anticorrosives to the water system, at least one selected from a group consisting of pyrophosphoric acids and pyrophosphates is employed as the anticorrosives and the initial protective film formation process is conducted such that the initial pH at the start of the initial protective film formation process is adjusted to be 5 or more and less than 7 so that the pH at the end of the initial protective film formation process becomes 7 or more.

20 Claims, 1 Drawing Sheet

CORROSION INHIBITION METHOD

RELATED APPLICATIONS

The present application is based on, and claims priority from, Japanese Application Number 2004-103429, filed Mar. 31, 2004, the disclosure of which is hereby incorporated by reference herein in its entirety.

FIELD OF THE INVENTION

The present invention relates to a novel corrosion inhibition method of inhibiting corrosion by forming an initial anticorrosion protective film on a surface of an iron-based metallic member, particularly of carbon steel, which is exposed to a water system.

BACKGROUND OF THE INVENTION

Carbon steel tubes are widely used not only for piping but also for heat exchanger tubes in a heat exchanger and the like. Since carbon steel tubes used for such applications corrode because of the exposure to aqueous solution, they are generally processed by corrosion inhibiting, namely, anticorrosion treatment. The anticorrosion treatment is carried out in various ways. In case of a cooling water system, a method of adding corrosion inhibitors, namely, anticorrosives into the water system is generally used. As the anticorrosives to be added into the water system, phosphoric acid and/or phosphate (hereinafter, referred to as "phosphate") base anticorrosives such as orthophosphoric acid, poly phosphoric acid, and phosphonic acid and zinc salt are widely employed. The addition of the anticorrosives forms a protective film on the surface of a metallic member such as a carbon steel tube, thereby inhibiting corrosion.

At the start of flowing water into a carbon steel tube which is newly installed and is not coated with anticorrosion coating or at the restart of flowing water into a carbon steel tube of which anticorrosion film is broken due to annual shut down, the carbon steel tube is treated to have a strong initial protective film formed thereon by adding anticorrosives in concentrated amounts into a water system in order to prevent corrosion just after starting or restarting water flow and to maintain a stable corrosion inhibition effect after that.

Conventionally, the treatment for forming an initial protective film is conducted by adding phosphate base anticorrosives or zinc salt in concentrated amounts into a-water system (Takahashi et al.: Water Re-use Technology, Vol. 14, No. 3, page 5 (1988), JP 2003-105573A). A film formed by the treatment for forming an initial protective film by using phosphate and zinc salt has a double layer structure composed of a precipitated layer made of P, Zn, Ca, O as the outer layer and a layer made mainly of iron oxide as the inner layer. Because of this double layer structure, the layer exhibits high anticorrosion effect (Kuniyuki Takahashi; corrosion inhibition '95 collection of lectures, A-305 (1995)).

Since there is the Environmental Standard which is 20 μg/L of zinc salt in a general sea water area, however, discharge of water containing zinc salt in concentrated amounts must be restricted. Accordingly, a corrosion inhibition method without using zinc salt is desired.

As a treatment for forming an initial protective film without using zinc salt, a method using anticorrosives of phosphate base such as sodium hexametaphosphate, with the total phosphate concentration being 100 mg-$PO_4$/L has been put to practical use. However, such a treatment has a problem that the phosphate flows into a river, a lake, and/or ocean, thus causing eutrophication of water quality. Therefore, phosphate use is also regulated. It is desired to treat with a phosphate concentration as low as possible.

As anticorrosives for forming an initial protective film containing neither phosphate base anticorrosives nor zinc salt base anticorrosives, a water treating agent composed of water soluble aluminate and a specified ethylenic unsaturated carboxylic acid based copolymer containing hydroxyl group has been known (JP 2000-5742A). Though this water treating agent enables formation of an initial protective film without using phosphate base anticorrosives and zinc salt base anticorrosives, aluminate component contained in the agent and silicate component contained in the water system cooperate together to produce gel substrates during a process increasing the concentration of the water system after the treatment for forming an initial protective film according to water condition, operation condition, or the like and the gel substrates adhere the surface of the metallic member. The gel substances sometimes induce corrosion. This means that the anticorrosion treatment using the water treating agent is not necessarily stable.

SUMMARY OF THE INVENTION

It is an object of the present invention to provide a corrosion inhibition method which minimizes environmental adverse effects by using phosphate base anticorrosives without using zinc salt base anticorrosives and by reducing the concentration of the phosphate base anticorrosives, enables stable formation of a good initial protective film, and does not affect water treatment after the formation of the initial protective film.

A corrosion inhibition method of the present invention comprises an initial protective film formation process of forming an initial protective film on a surface of an iron-based metallic member of a water system by adding anticorrosives to the water system. At least one selected from a group consisting of pyrophosphoric acids and pyrophosphates is employed as the anticorrosives. The initial pH at the start of the initial protective film formation process is adjusted to be 5 or more and less than 7 so that the pH at the end of the initial protective film formation process becomes 7 or more.

DETAILED DESCRIPTION OF PREFERRED EMBODIMENTS

Figure 1:
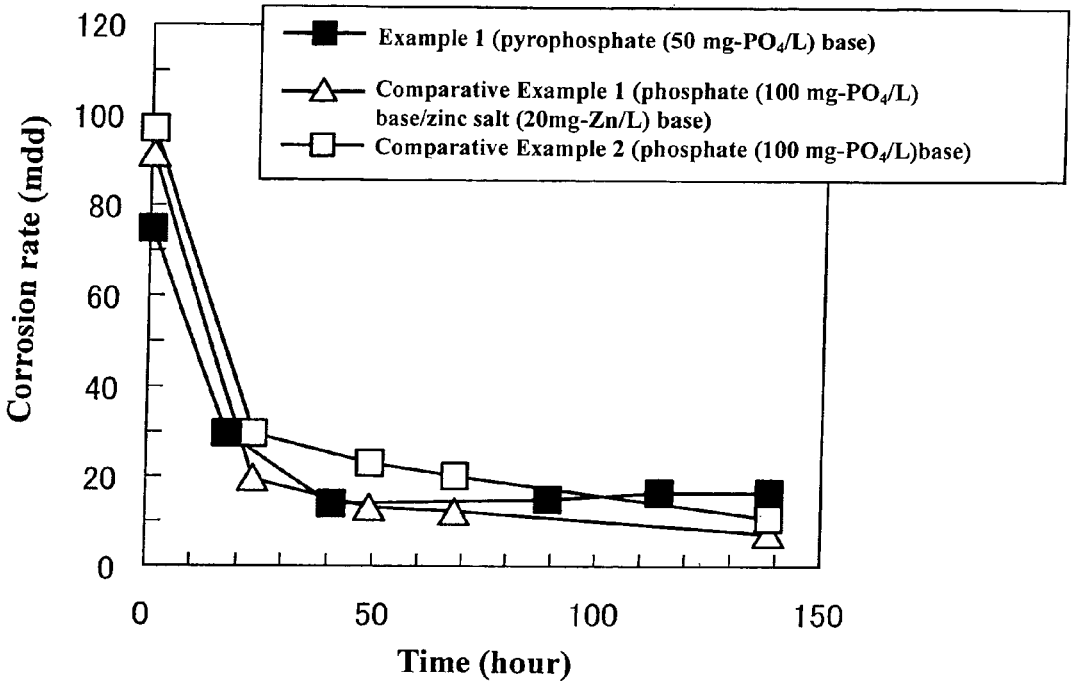
FIG. 1 is a graph showing changes in corrosion rate with time of Example 1 and Comparative Examples 1, 2.

The mechanism of excellent corrosion inhibiting effect by the corrosion inhibition method of the present invention has not been fully understood, but is deduced as follows.

Pyrophosphoric acid and/or pyrophosphate to be used as an anticorrosive component in a process of forming an initial protective film (hereinafter, referred to as "initial film formation process") of the present invention has a property of easily reacting with iron ion to generate hardly soluble iron pyrophosphate and of reacting with calcium ion to generate deposits. In the present invention, by adjusting the initial pH at the start of the initial film formation process to 5 or more and less than 7, i.e. mild acidic, defects in mill scale existing on the surface of an iron-based metallic member are homogenized and, in addition, suitable amount of iron is eluted from the surface of the iron-based metallic member as iron ion so that a film of iron pyrophosphate is formed on the metallic surface by action of the iron ion with pyrophosphoric acid and/or pyrophosphate existing in the water. After that, by action of a part of pyrophosphoric acid and/or pyrophosphate still remaining in the liquid with calcium ion while the pH of water where the treatment for forming the initial protective film is conducted is increased to 7 or more, a film containing phosphate and calcium is formed on the surface of the iron-based metallic member.

In this manner, according to the present invention, environmental adverse effects can be minimized by using phosphate base anticorrosives without using zinc salt base anticorrosives and by reducing the concentrated amounts of the phosphate base anticorrosives as compared to the conventional art, a good initial protective film can be stably formed, and excellent corrosion inhibition effect can be obtained. Further, the anticorrosion treatment of the present invention does not affect water treatment after the formation of an initial protective film, thereby maintaining stable operation of a water system.

Hereinafter, preferred embodiments of the corrosion inhibition method of the present invention will be described.

The water system to which the corrosion inhibition method of the present invention is applied preferably has water quality that the calcium hardness contained in water is from 30 mg to 150 mg-$CaCO_3$/L, especially from 50 mg to 80 mg-$CaCO_3$/L. If the calcium hardness is less than 30 mg-$CaCO_3$/L, the protective film containing phosphate and calcium as the second layer formed on the surface of the metallic member by action of the pyrophosphoric acid or pyrophosphate with calcium ion is not formed well. If the calcium hardness exceeds 150 mg-$CaCO_3$/L, there is a fear of deposition and adhesion of scales made of phosphate and calcium. It should be noted that, when the water system to be treated has water quality out of the aforementioned range, the water quality can be adjusted by adding or removing calcium hardness component.

The additive amount of the anticorrosives containing pyrophosphoric acid and/or pyrophosphate relative to the water system is preferably set such that the phosphate concentration after addition becomes from 20 mg to 70 mg-$PO_4$/L, especially from 30 mg to 50 mg-$PO_4$/L. If the phosphate concentration after addition is less than 20 mg-$PO_4$/L, it is impossible to form an effective protective film. If the phosphate concentration after addition exceeds 70 mg-$PO_4$/L, there is a risk of environmental impacts because of high concentration of the phosphates. When the phosphate concentration becomes below the aforementioned minimum line due to consumption of the anticorrosive component and the like during the initial film formation step, it is preferable to add the anticorrosives to maintain the phosphate concentration above the minimum line.

Examples of pyrophosphates as anticorrosives include alkali metal pyrophosphates such as potassium pyrophosphate and disodium pyrophosphate, alkali metal dihydrogen pyrophosphates such as disodium hydrogen pyrophosphate. These may be used alone or as a mixture. The anticorrosives may contain other phosphate base anticorrosive components besides the pyrophosphoric acid and/or pyrophosphate. Examples of the other phosphate base anticorrosive components include phosphoric acids and phosphates such as sodium phosphate, potassium phosphate, disodium hydrogen phosphate, dipotassium hydrogen phosphate, sodium dihydrogen phosphate, and potassium dihydrogen phosphate. In this case, the proportion of the pyrophosphate base anticorrosive component of the pyrophosphoric acid and/or pyrophosphate to the orthophosphate base anticorrosive component of the phosphoric acid and/or phosphate is set such that, when the ratio of the pyrophosphate base anticorrosive component is expressed as A and the ratio of the orthophosphate base anticorrosive component is expressed as B, a ratio of B/A is preferably from 0/100 to 80/20, particularly preferably from 0/100 to 70/30, especially preferably from 0/100 to 60/40 (weight ratio). If the ratio of the orthophosphate base anticorrosive component is higher than the aforementioned ratio, it is sometimes impossible to form an initial protective film exhibiting sufficient anticorrosion effects. The pyrophosphoric acid and pyrophosphate are degraded into orthophosphoric acid and orthophosphate because of hydrolysis. Also when the degradation progresses, it is preferable to adjust the proportion of the pyrophosphoric acid and/or pyrophosphate to the orthophosphoric acid and/or orthophosphate to be within the aforementioned range.

In the present invention, the aforementioned pyrophosphoate base anticorrosives are added to the water system and the initial pH is set to 5 or more and less than 7, preferably from 6.0 to 6.5. If the initial pH is 7 or more, the amount of iron ion eluted from the iron-based metallic member is poor, thus making it impossible to form a film of iron pyrophosphate as the first layer of the anticorrosion film on the surface of the iron-based metallic member. If the initial pH is less than 5, there is a risk that a metal to be treated or other metallic parts existing in the system may be corroded because of strong corrosive properties. There is no special limitation for the method for adjusting the initial pH. A method of adding acid such as hydrochloric acid or sulfuric acid is preferable.

In the present invention, the M alkalinity of the water system to which the anticorrosives are added and of which initial pH is set to 5 or more and less than 7 is preferably from 10 mg to 30 mg-$CaCO_3$/L, especially from 20 mg to 30 mg-$CaCO_3$/L. If the M alkalinity is less than 10 mg-$CaCO_3$/L, there is a fear that the pH at the end of the initial film formation process may not reach 7 or more. On the other hand, if the M alkalinity exceeds 30 mg-$CaCO_3$/L, the pH is rapidly increased during the initial film formation process, making it difficult to form an effective protective film. The M alkalinity differs between before and after the addition of the anticorrosives and the adjustment of the initial pH. When the M alkalinity after such treatment is out of the aforementioned range, it is preferable that the M alkalinity is lowered by adding acid or the M alkalinity is increased by adding alkali.

Normally, the initial film formation process is carried out at ordinary temperature. When there is a high temperature portion according to the target to be treated (for example, in case of carrying out the initial film formation process to a heat exchanger in operation), a high-molecular electrolyte having an effect of preventing deposition and/or adhesion of calcium phosphate-base scales is added if necessary in order to prevent adverse effects by the deposition and/or adhesion of calcium phosphate-base scales produced from the anticorrosive component and calcium ion in the water system. There is no special limitation on the high-molecular electrolyte so that the high-molecular electrolyte may be any one having such an effect of preventing deposition and/or adhesion of calcium phosphate-base scales. For example, an electrolyte which is prepared by copolymerizing a monomer of (meth)acrylic acid or (meth)acrylate and a monomer containing sulfonic acid group may be employed. Examples of the high-molecular electrolyte include a copolymer of (meth)acrylic acid or (meth)acrylate with 3-hydroxy-2-allyloxy propanesulfonic acid, and a copolymer of (meth)acrylic acid or (meth)acrylate with isoprenesulfonic acid and/or hydroxyethyl methacrylate. The high-molecular electrolyte is normally added in an amount of from 10 mg to 100 mg/L as solid content according to the condition of the water system to be treated.

The initial film formation process takes preferably from 1 to 5 days, more preferably form 3 to 5 days. In case of less than one day, it is impossible to form an effective initial protective film. Though the initial film formation process may take more than 5 days, the properties of the initial protective film are not changed even when it takes more than 5 days and it is not economical, for example, because the amount of the anticorrosives is increased for the purpose of maintaining the concentration of the anticorrosives.

In the present invention, the pH at the end of the initial film formation process is 7 or more. If the pH at the end of the initial film formation process is less than 7, the anticorrosion film of phosphate and calcium as the second layer formed by action of the pyrophosphoric acid and/or pyrophosphate of the anticorrosives with calcium ion of the water system can not be formed well. There is also no special limitation for the method for adjusting the pH at the end of the initial film formation process. It is preferable to gradually increase the pH while free carbon dioxides produced at adjustment of the initial pH are stripped by circulating treatment water into a cooling tower or the like. In case of excessively high pH at the end of the initial film formation process, there is a fear of deposition and adhesion of scales. Therefore, it is preferable to adjust the pH to be from 7 to 8.

In the initial film formation process, water which contains the anticorrosives is preferably in contact with the iron-based metallic member to be treated while the water flows.

After the end of the initial film formation process, a maintenance process for maintaining the initial protective film may be conducted. The film maintenance process is carried out by adding a suitable amount of anticorrosives which may be any of various conventional anticorrosives to the water system.

All water in the system may be replaced when the initial film formation process is shifted to the film maintenance process. Alternatively, the initial film formation process may be shifted to the film maintenance process with retaining a part or all of the water in the system. There is no special limitation on the anticorrosives to be added in the film maintenance process. Phosphoric acid, zinc salt base anticorrosives, phosphate base anticorrosives, and non-phosphate-base zinc salt base anticorrosives such as anticorrosives of high molecular electrolyte may be employed as the anticorrosives. The amount of the anticorrosives to be added in the film maintenance process depends on the kind of the anticorrosives used and is set to be such an amount to maintain the protective film formed in the previous process.

Also in the film maintenance process, a high-molecular electrolyte having an effect of preventing deposition and/or adhesion of calcium phosphate-base scales is added if necessary in order to prevent adverse effects by the deposition and/or adhesion of calcium phosphate-base scales produced from the component of the added anticorrosives and calcium ion. The high-molecular electrolyte may be any one of examples listed above as the high-molecular electrolyte to be added in the initial film formation process and is selectively selected according to the condition of the water system to be treated.

In the initial film formation process and the film maintenance process, a slime inhibitor, a scale inhibitor, an azole corrosion inhibitor for copper, and other anticorrosives may be used together if necessary.

EXAMPLES AND COMPARATIVE EXAMPLES

Hereinafter, the present invention will be concretely described with reference to examples and comparative examples.

The water quality of test water used in the following examples and comparative examples are shown in Table 1.

TABLE 1

Water quality of test water

| | (A) | (B) |
|---|---|---|
| pH | 7.8 | 8.9 |
| Conductivity (mS/m) | 40 | 65 |
| M-alkalinity (mg-$CaC_3$/L) | 80 | 120 |
| Calcium Hardness (mg-$CaC_3$/L) | 80 | 120 |
| Magnesium Hardness (mg-$CaC_3$/L)) | 40 | 60 |
| Chloride Ion (mg-$Cl^-$/L)) | 55 | 85 |
| Sulfate Ion (mg-$SO_4^{2-}$/L) | 40 | 60 |
| Silicate (mg-$SiO_2$/L) | 25 | 40 |

Evaluation Test for Anticorrosive Capability Against Rusted Surface

Example 1

Evaluation test for anticorrosive capability against a rusted surface by an initial protective film process using potassium pyrophosphate was conducted by the following method.

An electrode (ϕ10×30 mm) made of SS400 and etched was soaked in 1 L of industrial water shown in Table 1 (A) so as to develop rust. After that, potassium pyrophosphate was added to the industrial water such that the total phosphate concentration became 50 mg-$PO_4$/L. After that, by adding sulfuric acid, the initial pH was then adjusted to 6.0. The M alkalinity was 20 mg-$CaCO_3$/L. The test was conducted at room temperature under conditions of stirrer agitation and air aeration. The corrosion rate of the test electrode was timely measured by using a corrosion analyzer so as to obtain changes in corrosion rate with time. In this manner, the test was carried out. Electrodes (ϕ10×30 mm) made of SUS304 were used as a reference electrode and a counter electrode of the corrosion analyzer. The pH after 90 hours from the start of the test (pH at the end of the initial film formation process) was 7.17.

Comparative Example 1

Test was conducted in the same manner as Example 1, except that zinc chloride and sodium hexametaphosphate were added, instead of the potassium pyrophosphate, such that the total phosphate concentration became 100 mg-$PO_4$/L and the zinc ion concentration became 20 mg-Zn/L.

Comparative Example 2

Test was conducted in the same manner as Example 1, except that sodium hexametaphosphate was added, instead of the potassium pyrophosphate, such that the total phosphate concentration became 100 mg-$PO_4$/L.

FIG. 1 shows changes in corrosion rate with time in Example 1, Comparative Examples 1 and 2.

It is found from FIG. 1 that, without using zinc salt base anticorrosives and under a low phosphate concentration condition, Example 1 can exhibit anticorrosive effect nearly equal to that of Comparative Example 1 or 2 which uses phosphate base/zinc salt base anticorrosives in concentrated amounts or using phosphate base anticorrosives in concentrated amounts.

Evaluation Test for Strength of Initial Protective Film

Example 2

Evaluation test for strength of an initial protective film formed by an initial film formation process using potassium pyrophosphate was conducted by the following method.

Industrial water shown in Table 1 (A) was used as base water quality. Liquid solution was prepared by adding potassium pyrophosphate into the industrial water such that the total phosphate concentration became 50 mg-$PO_4$/L and, after that, adjusting the pH to 6.0 and M alkalinity to 24 mg-$CaCO_3$/L by using sulfuric acid. An electrode (ϕ10×30 mm) made of SS400 was soaked in 1 L of the liquid solution (hereinafter, referred to as "initial treating water") for 3 days. The pH after 3 days (pH at the end of the initial coating formation process) was 7.6.

After that, the water was replaced with industrial water shown in Table 1 (A) containing no anticorrosives (hereinafter, blank water). Then the test electrode was soaked for 3 days. The test was conducted at room temperature under conditions of stirrer agitation and air aeration. The corrosion rate of the test electrode was timely measured by using a corrosion analyzer. The strength of the initial protective film formed by the initial film formation process was evaluated according to the changes in corrosion rate with time after the initial treating water was replaced with the blank water. That is, as the increase in the corrosion rate after replacement with the blank water is steep, it was judged that the strength of the initial protective film was poor. Electrodes (ϕ10×30 mm) made of SUS304 were used as a reference electrode and a counter electrode of the corrosion analyzer.

Comparative Example 3

Test was conducted in the same manner as Example 2, except that zinc chloride and sodium hexametaphosphate were added, instead of the potassium pyrophosphate, such that the total phosphate concentration became 100 mg-$PO_4$/L and the zinc ion concentration became 20 mg-Zn/L.

Comparative Example 4

Test was conducted in the same manner as Example 2, except that sodium hexametaphosphate was added, instead of the potassium pyrophosphate, such that the total phosphate concentration became 100 mg-$PO_4$/L.

Figure 2:
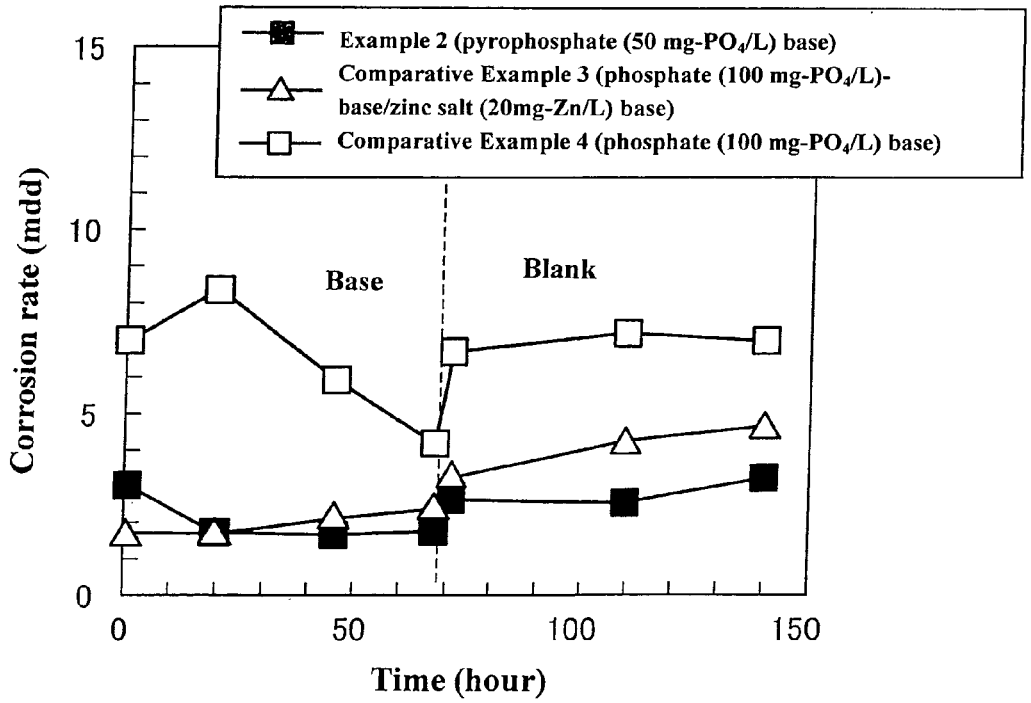
FIG. 2 is a graph showing changes in corrosion rate with time of Example 2 and Comparative Examples 3, 4.

FIG. 2 shows changes in corrosion rate with time in Example 2, Comparative Examples 3 and 4.

It was found from FIG. 2 that Example 2 which uses no zinc salt base anticorrosives and has low phosphate condition can obtain strength of the initial protective film which is higher than that of Comparative Example 4 using phosphate base anticorrosives in concentrated amounts and nearly equal to that of Comparative Example 3 using phosphate base/zinc salt base anticorrosives in concentrated amounts.

Evaluation Test for Anticorrosive Capability Under Condition Flowing Through a Carbon Steel Tube Example 3

Evaluation test for anticorrosive capability under condition flowing through a carbon steel tube of an initial protective film using potassium pyrophosphate was conducted by the following method.

Industrial water shown in Table 1 (A) was used as base water quality. Liquid solution was prepared by adding potassium pyrophosphate into the industrial water such that the total phosphate concentration became 50 mg-$PO_4$/L and, after that, adjusting the pH to 6.0 by using sulfuric acid. 50 L of the liquid solution having a pH of 6.0 and an M alkalinity of 28 mg-$CaCO_3$/L (hereinafter, referred to as "initial treating water") was flowed through a carbon steel tube of ϕ19×200 mm for 4 days. The pH after 4 days (pH at the end of the initial coating formation process) was 7.8.

After that, simulant cooling water shown in Table 1 (B) (hereinafter, referred to as "maintenance treating water") into which sodium phosphate was added to be 6 mg-$PO_4$/L as phosphate base anticorrosives was flowed through the carbon steel tube for 7 days. The temperature of the initial treating water was 30° C., the temperature of the maintenance treating water was 40° C., and the flow rate of either case was 0.1 m/s. It was checked whether or not there was pitting after the maintenance treating water was passed for 7 days. When pitting corrosion was developed, the depth of the maximum pitting was measured.

Comparative Example 5

Test was conducted in the same manner as Example 3, except that zinc chloride and sodium hexametaphosphate were added, instead of the potassium pyrophosphate, in the initial film formation process such that the total phosphate concentration became 100 mg-$PO_4$/L and the zinc ion concentration became 20 mg-Zn/L.

Comparative Example 6

Test was conducted in the same manner as Example 3, except that sodium hexametaphosphate was added, instead of the potassium pyrophosphate, in the initial film formation process such that the total phosphate concentration became 100 mg-$PO_4$/L.

Results in Example 3 and Comparative Examples 5, 6 are shown in

TABLE 2

| | Initial film formation process | | Pitting | |
|---|---|---|---|---|
| | Anticorrosives | Concentration (mg/L) | Status | Depth of Max pitting (mm) |
| Example 3 | pyrophosphate base | 50 (as $PO_4$) | absence | — |
| Comparative Example 5 | phosphate base<br>zinc salt base | 100 (as $PO_4$)<br>20 (as Zn) | absence | — |
| Comparative Example 6 | phosphate base | 100 (as $PO_4$) | presence | 0.09 |

It was found from Table 2 that Example 3 which uses no zinc salt base anticorrosives and has low phosphate condition can obtain anticorrosive effect which is higher than that of Comparative Example 6 using phosphate base anticorrosives in concentrated amounts and nearly equal to that of Comparative Example 5 using phosphate base/zinc salt base anticorrosives in concentrated amounts.

What is claimed is:

1. A corrosion inhibition method for a surface of an iron-based metallic member of a water system, comprising:

adding at least one anticorrosive to the water system, said at least one anticorrosive being selected from a group consisting of pyrophosphoric acids and pyrophosphates, wherein said at least one anticorrosive is added such that a total phosphate concentration of the water system is in a range of from 20 mg to 70 mg-$PO_4$/L, forming a first protective film of iron pyrophosphate by adjusting an initial pH at a start of an initial protective film formation process to be 5 or more and less than 7 and eluting iron ions from the iron-based metallic member, terminating the formation of the first protective film by increasing the pH to 7 or more, and forming a second film containing phosphate and calcium on the surface of the first protective film by maintaining the pH of 7 or more.

2. A corrosion inhibition method as claimed in claim 1, wherein said at least one anticorrosive is added such that the total phosphate concentration of the water system is in a range of from 30 mg to 50 mg-$PO_4$/L.

3. A corrosion inhibition method as claimed in claim 1, wherein the pyrophosphate is alkali metal pyrophosphates and/or alkali metal dihydrogen pyrophosphates.

4. A corrosion inhibition method as claimed in claim 1, wherein the at least one anticorrosive contains at least one pyrophosphate base anticorrosive component selected from the group consisting of pyrophosphoric acids and pyrophosphates and at least one orthophosphate base anticorrosive component selected from the group consisting of orthophosphoric acids and orthophosphates; and wherein, when a content of the pyrophosphate base anticorrosive component is expressed as A and a content of the orthophosphate base anticorrosive component is expressed as B, a ratio of B/A is in a range of from 0/100 to 80/20 (weight ratio).

5. A corrosion inhibition method as claimed in claim 4, wherein the ratio of B/A is in a range of from 0/100 to 60/40 (weight ratio).

6. A corrosion inhibition method as claimed in claim 4, wherein the at least one anticorrosive contains at least one phosphate selected from the group consisting of sodium phosphate, potassium phosphate, disodium hydrogen phosphate, dipotassium hydrogen phosphate, sodium dihydrogen phosphate, and potassium dihydrogen phosphate.

7. A corrosion inhibition method as claimed in claim 1, wherein calcium hardness in the water system to be processed by the protective film formation process is from 30 mg to 150 mg-$CaCO_3$/L; and wherein a high-molecular electrolyte having an effect of preventing deposition and/or adhesion of calcium phosphate-base scales is added into the water system if necessary.

8. A corrosion inhibition method as claimed in claim 7, wherein the calcium hardness in the water system to be processed by the protective film formation process is from 50 mg to 80 mg-$CaCO_3$/L.

9. A corrosion inhibition method as claimed in claim 7, wherein said high-molecular electrolyte is an electrolyte which is prepared by copolymerizing a monomer of (meth) acrylic acid or (meth)acrylate and a monomer containing sulfonic acid group.

10. A corrosion inhibition method as claimed in claim 7, wherein the high-molecular electrolyte is added in an amount of from 10 mg to 100 mg/L as solid content.

11. A corrosion inhibition method as claimed in claim 1, wherein the initial pH at the start of the protective film formation process is adjusted to be a range of from 6.0 to 6.5 and the pH at the end of the protective film formation process is adjusted to be a range of from 7 to 8.

12. A corrosion inhibition method as claimed in claim 1, wherein M alkalinity of the water system which contains the at least one anticorrosive and of which initial pH is set to 5 or more and less than 7 is in a range of from 10 mg to 30 mg-$CaCO_3$/L.

13. A corrosion inhibition method as claimed in claim 12, wherein the M alkalinity of the water system which contains the at least one anticorrosive and of which initial pH is set to 5 or more and less than 7 is in a range of from 20 mg to 30 mg-$CaCO_3$/L.

14. A corrosion inhibition method as claimed in claim 1, wherein the protective film formation process takes from 1 to 5 days.

15. A corrosion inhibition method as claimed in claim 1, further comprising a film maintenance process for maintaining the protective film which is conducted by adding anticorrosives into the water system after the protective film formation process.

16. A corrosion inhibition method as claimed in claim 1, wherein said at least one anticorrosive consists essentially of at least one phosphoric anticorrosive.

17. A corrosion inhibition method, for a surface of an iron-based metallic member of a water system, consisting essentially of:

adding at least one anticorrosive to the water system, said at least one anticorrosive consisting essentially of at least one phosphoric anticorrosive, said at least one phosphoric anticorrosive being selected from a group consisting of pyrophosphoric acids and pyrophosphates, wherein said at least one anticorrosive is added such that a total phosphate concentration of the water system is in a range of from 20 mg-$PO_4$/L, adjusting initial pH at a start of an initial protective film formation process to be 5 or more and less than 7 to form a first film of iron pyrophosphate by eluting iron ions from the iron-based metallic member, terminating the formation of the first film by increasing the pH so that the pH becomes 7 or more, and forming a second film containing phosphate and calcium on the surface of the first film by maintaining the pH in a range of 7 or more, wherein, in the protective film formation process, the water which contains the at least one phosphoric anticorrosive is in contact with an iron-based metallic member to be treated while the water flows.

18. A corrosion inhibition method as claimed in claim 15, wherein the at least one anticorrosive is at least one selected of from the group consisting of phosphoric acid, phosphate base anticorrosives, and non-phosphate base zinc salt base anticorrosives.

19. A corrosion inhibition method as claimed in claim 15, wherein a part or all of water in the system is replaced when the protective film formation process is shifted to the film maintenance process.

20. A corrosion inhibition method as claimed in claim 15, wherein a high-molecular electrolyte having an effect of preventing deposition and/or adhesion of calcium phosphate-base scales is added during the film maintenance process.

* * * * *